US011446733B2

(12) United States Patent
Zumbusch

(10) Patent No.: US 11,446,733 B2
(45) Date of Patent: Sep. 20, 2022

(54) ONE-PIECE FEEDER BODY FOR USE WHILE CASTING METALS

(71) Applicant: Chemex Foundry Solutions GmbH, Delligsen (DE)

(72) Inventor: Lars Zumbusch, Langenfeld (DE)

(73) Assignee: CHEMEX FOUNDRY SOLUTIONS GMBH, Delligsen (DE)

( * ) Notice: Subject to any disclaimer, the term of this patent is extended or adjusted under 35 U.S.C. 154(b) by 0 days.

(21) Appl. No.: 17/420,470

(22) PCT Filed: Feb. 14, 2020

(86) PCT No.: PCT/EP2020/053854
§ 371 (c)(1),
(2) Date: Jul. 2, 2021

(87) PCT Pub. No.: WO2020/169462
PCT Pub. Date: Aug. 27, 2020

(65) Prior Publication Data

US 2022/0080493 A1 Mar. 17, 2022

(30) Foreign Application Priority Data

Feb. 19, 2019 (DE) ..... 102019104180.5

(51) Int. Cl.
*B22C 9/08* (2006.01)

(52) U.S. Cl.
CPC ..... *B22C 9/088* (2013.01)

(58) Field of Classification Search
CPC ..... B22C 9/08; B22C 9/088
See application file for complete search history.

(56) References Cited

U.S. PATENT DOCUMENTS

2016/0236270 A1 8/2016 Zumbusch

FOREIGN PATENT DOCUMENTS

| | | |
|---|---|---|
| DE | 29510068 | 10/1996 |
| DE | 10039519 | 2/2002 |
| DE | 102010054513 | 6/2012 |
| DE | 202015104866 | 11/2015 |
| DE | 102015103593 | 5/2016 |

*Primary Examiner* — Kevin P Kerns
*Assistant Examiner* — Steven S Ha
(74) *Attorney, Agent, or Firm* — Duane Morris LLP; Gregory M. Lefkowitz

(57) ABSTRACT

The invention relates to a single-part feeder body for use as a feeder insert or component of a two-part or multi-part feeder insert in metal casting, having a feeder wall which at least partially delimits a feeder cavity for receiving liquid metal, wherein the feeder wall has an inner surface facing toward the feeder cavity, an outer surface for bearing against a mold material that surrounds the feeder body in certain regions, and a passage opening for the liquid metal into the feeder cavity, wherein the feeder wall has, on the inside, one, two or more material recesses for forming one or more outwardly protruding projections on the metal solidifying within the feeder cavity.

20 Claims, 3 Drawing Sheets

ONE-PIECE FEEDER BODY FOR USE WHILE CASTING METALS

CROSS-REFERENCE TO RELATED APPLICATIONS

Figure 1:
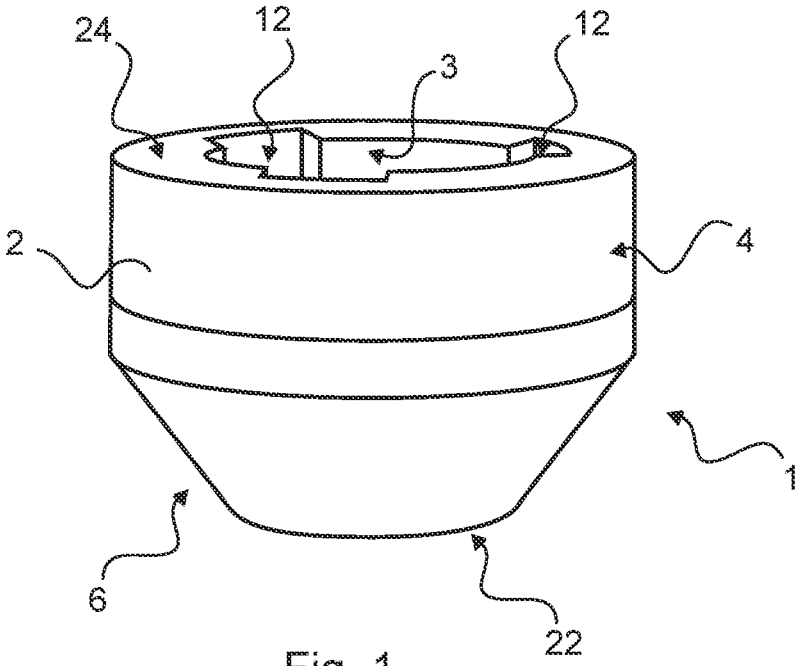

This application is a § 371 national stage entry of International Application No. PCT/EP2020/053854, filed on Feb. 14, 2020, which claims priority to German Patent Application No. 102019104180.5, filed on Feb. 19, 2019, the entire contents of which are incorporated herein by reference.

The invention relates to a single-part feeder body for use as a feeder insert or component of a two-part or multi-part feeder insert in metal casting, having a feeder wall which at least partially delimits a feeder cavity for receiving liquid metal, wherein the feeder wall has an inner surface facing toward the feeder cavity, an outer surface for bearing against a mold material that surrounds the feeder body in certain regions, and a passage opening for the liquid metal into the feeder cavity. The invention furthermore relates to a feeder insert for use in metal casting in casting molds, to a kit for producing feeder inserts, and to a device for producing a feeder body.

A multitude and variety of single-part feeder bodies are used in metal casting in casting molds; such feeder bodies are at least part of a feeder insert, also referred to as feeder system. Such a single-part feeder body is, during operation, largely surrounded by a mold material used to produce a casting mold, such as molding sand, and is thus held in position relative to a mold cavity in the casting mold. The known single-part feeder bodies have a feeder wall which is configured to at least partially delimit a feeder cavity for receiving the liquid metal. The feeder wall of the feeder body has an inner surface, which faces toward the feeder cavity, and an outer surface, which is regionally surrounded by the mold material that forms the casting mold. The feeder wall furthermore has a passage opening for the liquid metal into the feeder cavity. During the casting process, a partial quantity of the liquid material enters the feeder cavity, which is at least partially delimited by the feeder body, via the passage opening. The metal which serves for the refeeding of the casting and which is situated in the feeder cavity is kept in the liquid state for a certain period of time until the metal present in the casting mold has already partially solidified.

After the casting has solidified and at least partially cooled, the casting must be removed from the casting mold and undesired casting residues, such as a residual feeder protruding from the casting, must be re-moved. To remove them, they can be knocked off using a hammer or removed with the aid of a cutting device. Casting residues can also be separated off by means of a hydraulically driven separating wedge, wherein there is a considerably reduced risk of injury in relation to separation by means of a hammer or a cutting disk. To separate off the residues, two mutually oppositely arranged surfaces are usually required, between which the separating wedge is placed. When the separating wedge is actuated, forces are exerted on the surfaces in opposite directions, and the surfaces are thus displaced from one another. Difficulties arise in the separating-off process in particular if, on the casting, there are protruding residual feeders which narrow conically in the connection region to the casting or if the underside, facing toward the casting, of the residual feeder is arranged with such a small spacing that the separating wedge cannot be placed between these two surfaces.

Typical feeder bodies are known for example from EP 1 184 104 B2 or DE 10 2015 202 709 A1.

Reference is also made to the following prior art: DE 10 2015 103 593 B3, DE 100 39 519 A1, DE 10 2010 054 513 A1, DE 295 10 068 U1, and DE 20 2015 104 866 U1.

Based on the above-stated problem, the invention is based primarily on the object of providing a single-part feeder body, a feeder insert and a device for producing a feeder body, by means of which the separating-off of a corresponding residual feeder protruding from a casting is simplified and in particular is made possible whilst avoiding the disadvantages described above.

The invention achieves the object on which it is based by means of a feeder body having the features according to claim 1. According to the invention, the feeder wall of a corresponding single-part feeder body has, on the inside, one, two or more material recesses for forming one or more outwardly protruding projections on the metal solidifying within the feeder cavity.

The invention thus relates to a single-part feeder body for use as a feeder insert or component of a two-part or multi-part feeder insert in metal casting, having a feeder wall which at least partially delimits a feeder cavity for receiving liquid metal, wherein the feeder wall has an inner surface facing toward the feeder cavity, an outer surface for bearing against a mold material that surrounds the feeder body in certain regions, and a passage opening for the liquid metal into the feeder cavity, wherein the feeder wall has, on the inside, one, two or more material recesses for forming one or more outwardly protruding projections on the metal solidifying within the feeder cavity. Preferably, a mounting region for the mounting of the feeder body on a mold model and/or on a mold plate, or a wall region for forming a wall section of the mold cavity of a casting mold, is provided on the outer surface in the region of the passage opening of the feeder body. According to the invention, the approach is followed here of forming a residual feeder by means of the material recess on the inner surface of the feeder body during the solidification of the metal after the casting process, which residual feeder, on its surface, has one or more outwardly protruding defined projections. The outwardly protruding projections form, in particular, counter-bearings for a separating wedge that can be brought into operative connection with the projection. In particular, a targeted region of engagement for the separating wedge on a residual feeder that protrudes from the casting is created by means of the projections.

The feeder body according to the invention is preferably designed as a single-part open or single-part closed feeder insert. In the present case, the term "single-part" is to be understood to mean that the feeder body is formed from a single-part component. Such a "single-part" feeder body may also originally be formed from multiple individual parts, but these are then not intended or suitable for being arbitrarily separated from one another and joined together again or moved relative to one another. Even if it is assembled from multiple individual parts, a feeder insert is "single-part" if for example the feeder body is formed into a closed feeder insert by means of a cover, wherein the individual parts then permanently interact with one another.

A single-part feeder insert preferably cannot be reversibly dismantled into its individual parts; that is to say, after dismantling, the individual parts cannot readily be reassembled into a functional whole.

According to a preferred embodiment of the single-part feeder body, the one material recess or at least one of the two or more material recesses defines an inner surface section, facing toward the passage opening, of the feeder wall, which inner surface section is at an angle α in the range of 70° to 110°, preferably at an angle α in the range of 80° to 100°, with respect to the central axis of the passage opening, and/or has one or more planar surface regions which protrude outward in the feeder wall. The planar inner surface section preferably runs at a right angle α with respect to the central axis of the passage opening. In a preferred embodiment, the profile of the inner surface section of the material recess is adapted to the component geometry of the casting to be produced, such that a planar surface thereby defined on a residual feeder runs approximately parallel to a surface of the casting to be generated. The surface on the casting is preferably arranged opposite the surface on the material projection of the residual feeder.

The material recess is preferably designed such that metal solidifying in the feeder cavity forms an undercut. The liquid metal solidifying within the feeder cavity of the single-part feeder body fills the material recess at least partially, preferably completely, such that a form fit is brought about between the solidifying metal in the feeder cavity and the material recess. That region of the solidified material of the residual feeder which is defined by the inner surface section on the feeder body preferably forms a surface on the material projection, which surface can serve as a force engagement surface for the separating wedge.

A preferred refinement of the single-part feeder body according to the invention provides that multiple material recesses are arranged on the inner surface at angular intervals around the central axis of the passage opening, preferably at uniform angular intervals around the central axis of the passage opening. With the provision of multiple material recesses, it is preferably the case that, in accordance with the number of material recesses, a corresponding number of projections is generated on the solidifying residual feeder. It is thus preferably effected that at least one of the material recesses on the inner surface of a feeder body is assigned to a wall region of the casting mold which delimits a surface region of the later casting, which surface region can be used as a counterbearing for the separating wedge to be applied to the residual feeder. In particular, a rotationally symmetrical feeder body, which thus has no preferred direction with regard to the arrangement in the casting mold, can thus be inserted arbitrarily within the casting mold without regard to its orientation. Preferably, the multiple material recesses are arranged approximately at the same height proceeding from the mounting region with the passage opening or the wall region with its passage opening, and are arranged on the inner surface at uniform angular intervals with respect to one another along the circumference.

According to a preferred embodiment of the single-part feeder body according to the invention, three material recesses are arranged on the inner surface with an offset of approximately 120 angular degrees with respect to one another. This results in correspondingly associated three projections, offset with respect to one another at an angle of 120°, on a residual feeder. This means that at least one of the projections protruding from the residual feeder should correspond to a surface of the casting for the application of the separating wedge. Depending on the casting geometry to be created, in particular in a manner dependent on the size of the casting to be generated, it is also possible for four material recesses to be formed on the inner surface of the feeder body with an offset of preferably 90° with respect to one another. In a further embodiment, a single material recess may be provided, which is preferably designed as an encircling step on the inner surface of the feeder body. Fully independent orientation of the feeder body with its material recess with respect to the generating casting mold is thus achieved within the casting mold.

According to a preferred refinement of the single-part feeder body according to the invention, the feeder cavity narrows from the material recess in the direction of the passage opening and/or a constriction with a minimal passage cross section is integrated into the feeder body in the region of the passage opening. The inner surface of the single-part feeder body preferably narrows in the shape of a funnel in the direction of the passage opening. In one embodiment, the material recess partially forms a step in the circumferential direction on the inner surface which narrows in cross section. Furthermore, a sharp breaking edge preferably is generated by the narrowing cross section and/or the constriction in the transition region between the mold cavity of the casting mold and the feeder cavity defined at least partially by the feeder body. This simplifies the separation of the solidified residual feeder from the later casting. In the case of a rotationally symmetrical feeder body, for example, the inner surface generally narrows uniformly in the direction of the passage opening. In an embodiment which has an inner surface with an oval configuration in cross section, the inner surface accordingly generally narrows non-uniformly. In the case of an oval configuration, the inner surface of the feeder body has surface regions with different angles of inclination with respect to the passage opening. The inner surface of the feeder body preferably has a shape similar to a straight truncated cone or an oblique truncated cone.

According to a preferred refinement of the feeder body according to the invention, the feeder body has a first end, which defines the passage opening and which is preferably defined by the mounting region or the wall region, and an oppositely situated second end, which is open.

It is preferably provided that the one material recess or at least one of the two or more material recesses, preferably all of the material recesses, extend as far as the open second end. The material recess or the material recesses on the inner surface is or are preferably formed without undercuts in the direction of the second end. This has the effect, in particular during the production of the feeder body according to the invention, that the produced feeder body can be easily removed from a mold part that forms the inner surface of the feeder body. In one embodiment of the feeder body according to the invention, the material recess extends as far as the second end of the feeder body according to the invention. Preferably, a feeder body with a material recess extending as far as the second end of the feeder body has a wall thickness that is substantially constant over the entire height of the material recess. In a further embodiment of the feeder body according to the invention, the material recess may be formed on the inner surface of the feeder body such that, proceeding in the direction of the second end of the feeder body from the undercut generated by the inner surface section on the inner surface of the feeder body, the material recess, in particular in the case of a conical shape of the inner surface, ends below the second end of the feeder body. Such a feeder body according to the invention preferably has a wall thickness that changes in the region of the material recess. Proceeding from the undercut at the material recess, the feeder body has a wall thickness that increases in the direction of its second end.

A preferred refinement of the feeder body according to the invention provides that the material recess on the inside has a height parallel to the central axis of the passage opening, which height is in the range of approximately 0.25 to approximately 0.5 in relation to the total height of the feeder body. Depending on the basic dimensions of the feeder body, the material recess thus preferably has a height which corresponds to at least a quarter to approximately half of the total height of the feeder body according to the invention. The width of the material recess formed on the inner surface varies in a manner dependent on the external dimensions of the feeder body. In relation to the circumference of the inner surface, the respective material recess preferably has an angular dimension along the inner surface of approximately 10° to 30°.

In a preferred embodiment of the single-part feeder body, the material recess has a height parallel to the central axis of the passage opening of at least 10 mm and/or a thickness, measured perpendicular to the central axis of the passage opening, of at least 3 mm and/or a minimum spacing to the passage opening of approximately 10 mm, preferably a spacing in a range of approximately 15 to approximately 20 mm. A residual feeder composed of a metal solidified within a feeder body designed in this way has, on its outer surface, a projection which preferably protrudes outward at its lower end by at least 3 mm from the surface; and/or the material projection has a height of at least 10 mm. Furthermore, it is preferably provided that the material projection extends at least approximately over 10 angular degrees along the circumference of the residual feeder. On the one hand, it is achieved by means of the minimum thickness that, during the removal of the residual feeder by means of a wedge, the separating wedge cannot inadvertently slide on the material projection. By means of the at least 3 mm wall thickness, a sufficiently large surface area is generated as a counterbearing for the separating wedge that is to be applied to this projection of the residual feeder. The minimum spacing between the material recess and the passage opening of at least 10 mm, preferably the spacing in a range of approximately 15 to 20 mm, results in a sufficiently large spacing between the material projection on the residual feeder and the casting for reliable application of a separating wedge.

A single-part feeder body according to the invention is preferred in which the feeder body (i) is formed from exothermic feeder material or comprises exothermic feeder material at least in certain sections and/or (ii) is formed from insulating feeder material or comprises insulating feeder material in certain sections. With the use of exothermic feeder material, the material situated in the feeder cavity is preferably kept in a liquid state for a relatively long period of time. Preferably, in one embodiment, the entire single-part feeder body is formed from an exothermic feeder material. Alternatively or optionally, the feeder body according to the invention may also be composed entirely or only partially of an insulating feeder material bound with a binding agent, by means of which the release of heat from the interior of the feeder body is reduced in a simple manner.

A refinement of the invention provides that the feeder cavity is designed to be rotationally symmetrical around the central axis of the passage opening and/or the outer surface of the feeder body is designed to be symmetrical in a plane running through the central axis of the passage opening, preferably rotationally symmetrical about the central axis, and/or the feeder body has a mounting region which narrows in the direction of the passage opening and which serves for mounting on a mold model or on a mold plate.

A further aspect of the present invention relates to a two-part or multi-part feeder insert for use in metal casting in casting molds. According to the invention, it is provided that the feeder insert comprises at least one feeder body according to the invention (preferably according to one of the embodiments described above as being preferred) and one or more further feeder elements, wherein the feeder body is connected to the one or more further feeder elements to form the feeder insert and wherein the feeder body together with the one further or together with at least one of the further feeder elements defines the feeder cavity. The invention thus relates to a two-part or multi-part feeder insert, in which the feeder body according to the invention interacts in particular with at least one further feeder element to form the feeder cavity. For the use according to the invention, the multi-part feeder insert is assembled from the single-part feeder body and the at least one feeder element. In the present case, a two-part or multi-part feeder insert is to be understood in particular to mean a feeder insert assembled from the feeder body and at least one individual further feeder element. According to a preferred embodiment, the feeder body and the (at least one further) feeder element can perform a relative movement with respect to one another, or the feeder body and the (at least one further) feeder element can be reversibly separated from one another and joined together again as often as desired.

A preferred refinement of the feeder insert according to the invention provides that the feeder body and the second feeder element that corresponds with the feeder body are designed to be telescopic relative to one another. Such a multi-part feeder insert is designed in particular as a "telescopic feeder", wherein, in particular during the compaction of the mold material, one part of the feeder insert (for example the feeder body) is pushed into the other or one part of the feeder insert (for example the feeder body) is pushed over the other. The feeder bodies and (further) feeder elements which are designed to be telescopic relative to one another are then preferably designed to be compressible (telescopic) along their longitudinal axes, such that the spacing between mutually opposite ends of the two-part or multi-part feeder insert is variable. In the case of a two-part or multi-part feeder insert according to the invention designed as a "telescopic feeder", the feeder body according to the invention and the one or more feeder elements are moved relative to one another (cf. DE 100 39 519 A1). The associated feeder element is preferably pushed at least in certain sections over the feeder body during the compaction of the mold material used to form the casting mold. Here, the feeder body and feeder element are generally not designed to be deformable in themselves. In particular, the feeder body of a two-part or multi-part feeder insert preferably has a first end which is designed as a mounting region and which has the passage opening and which is provided for mounting on a mold model or on a mold plate. The feeder body of such a two-part or multi-part feeder insert then preferably does not change its position relative to the mold plate or the mold model during the compaction of the mold material. During the compaction of the mold material, it is thus primarily the associated feeder element that is moved.

A refinement of the feeder insert according to the invention provides that the feeder body has a narrowing mounting region on its outer surface and/or the feeder body, as a lower part of a feeder insert, is of rotationally symmetrical form. The outer surface of the feeder body is preferably constricted from the second end of the feeder body in the direction of the first end with the passage opening. It is achieved in this way that, during the production of the casting mold, a sufficient quantity of mold material collects below the feeder insert and, in particular during the compaction, a sufficiently high strength is achieved in the region around the feeder insert. Furthermore, the constricting region of the feeder body has the effect that the solidified residual feeder that protrudes from the casting is separated off in an improved manner. In a refinement, the feeder body according to the invention is preferably of rotationally symmetrical form for use as a lower part of a feeder insert. A feeder body of such rotationally symmetrical form can be arranged without an arbitrary preferential direction within a mold cavity for forming a casting mold.

In an alternative embodiment, the feeder body according to the invention is of asymmetrical form. In particular, a feeder body of a side feeder for use in vertically separable casting molds, which has a volume center of gravity of the feeder cavity which is offset in relation to the central axis of the passage opening, is of asymmetrical form. A feeder body of such asymmetrical form also preferably has, on its inner surface, one or more material recesses according to the invention as described in more detail above.

Another aspect of the present invention relates to a kit for producing a feeder insert, comprising one or more feeder bodies according to any of the preferred embodiments described above, and at least two further feeder elements which correspond with the one or more feeder bodies according to the invention (preferably according to any of the preferred embodiments described above) such that two or more different feeder inserts can be generated, the feeder cavities of which have different volumes.

The invention is in this respect based on the additional concept of being able to assemble a single feeder body according to the invention with different feeder elements, which are of different configuration, to form a feeder insert. Preferably, the one or more feeder bodies have in each case one coupling section which is designed to be complementary to or to correspond with a respective coupling region of a feeder element to be joined together therewith. In order to be able to combine different feeder bodies according to the invention with different feeder elements, the coupling regions of the different feeder bodies and the coupling regions of the different feeder elements are preferably in each case of identical form.

Furthermore, the kit according to the invention preferably comprises a centering mandrel which corresponds with the passage opening in the one feeder body or in at least one of the at least two feeder bodies according to any of the preferred embodiments described above. A perpendicular orientation of the feeder insert with the feeder body according to the invention and with the feeder element with respect to the mold plate or with respect to the mold model is preferably realized by means of the centering mandrel. The centering mandrel preferably has a centering mandrel base which has a shaping adapted to the shape of the passage opening. In a preferred embodiment, in which the passage opening does not comprise a cylindrical cross section but preferably has a cross section preferably selected from the group comprising oval, non-circular, flattened circle and polygonal, and the cross section of the centering mandrel base is of complementary form with respect to the cross section of the passage opening, at least the one or more feeder bodies are received in form-fitting fashion on the centering mandrel. Preferably, a rotation-preventing securing action is generated between the centering mandrel and the one or more feeder bodies, whereby the feeder body can be brought into contact with the centering mandrel in one or more preferential relative positions. In particular, a feeder body with its material recesses present on the inner surface can be oriented in targeted fashion with respect to the mold plate or with respect to the mold model. In this way, the material recesses can be positioned in targeted fashion with respect to the casting to be produced.

In a further aspect, the invention relates to a device for producing a feeder body according to the invention, in particular a molding box, having at least two mold parts which are movable relative to one another, wherein a first mold part is configured to at least regionally form the outer surface of the feeder body, and wherein a second mold part is configured to form the inner surface, which at least regionally delimits the feeder cavity, of the feeder body. The device according to the invention achieves the object described in the introduction in that the second mold part, on its surface that at least regionally forms the inner surface of the feeder body, has one or more outwardly protruding mold part projections which are configured to form the material recess or material recesses. The invention is based on the realization that, by means of at least one mold part projection on the second mold part, which preferably forms the inner surface of the feeder body, a possibility of forming a material recess on the inner surface is achieved. The mold part projections are preferably of step-free form in the direction of the second end of the feeder body to be generated. The mold part projections preferably form, in the direction of the first end at which the passage opening for the liquid metal is formed, an undercut on the inner surface of the feeder body to be generated. Liquid metal then enters the undercuts of the material recess during the casting operation, which after solidification of the metal within the feeder body forms a residual feeder with outwardly protruding projections on the residual feeder, which projections serve as force engagement surfaces for a separating wedge to be applied thereto. In a preferred embodiment of the device according to the invention, two, three or more mold part projections are arranged on the second mold part, which projections are preferably arranged at uniform angular intervals around the central axis of the second mold part.

A yet further aspect of the present invention relates to the use of a device according to the invention for producing a feeder body according to the invention. In particular during the use of the device according to the invention, a mold material is introduced into a cavity between a first mold part and a second mold part; the introduced mold material is subsequently compacted by a relative movement of the first and second mold parts with respect to one another, and a feeder body with an inner surface which has one or more setback material recesses is generated, wherein, counter to the direction of removal of the feeder body from the second mold part, the material recess is formed without undercuts, such that the feeder body can be removed from the second mold part in a non-destructive manner.

A single-part feeder body according to the invention which can be produced by means of the device according to the invention and which has at least one material recess on its inner surface can be produced by way of the above method steps without disadvantageous additional outlay. According to a preferred embodiment, the mold part projections on the second mold part used to configure the inner surface of the feeder body are arranged such that the material recesses extend on the inner surface as far as the second end of the feeder body. In an alternative embodiment, the material recesses on the inner surface end below the second end of the feeder body.

In yet another aspect, the invention relates to a method for producing a casting with a residual feeder arranged thereon, wherein the residual feeder has at least one material projection as a counterbearing for a separating wedge that can be brought into contact with the material projection, comprising at least the steps: providing or producing a casting mold which is equipped with at least one feeder body according to the invention (preferably according to any of the preferred embodiments described above) and which has a mold cavity; casting liquid metal into the mold cavity of the casting mold through a sprue formed on the casting mold, such that liquid metal enters the feeder cavity, and allowing the metal to solidify in the mold cavity and in the feeder cavity, such that the residual feeder is formed as a result. The present method according to the invention is also based inter alia on the realization that, by means of material projections which protrude outward from the surface of the residual feeder and to which a separating wedge can be applied, a casting residue that remains as a residual feeder after the casting process can be separated off more easily. The material projection preferably has a planar surface, which is preferably oriented parallel to an oppositely arranged surface of the generated casting. A separating wedge used to separate off the casting residues can thus be securely applied to the substantially mutually oppositely situated surfaces.

Within the provided or produced casting mold, there is arranged a single-part feeder body according to the invention which is designed as a single-part open or closed feeder insert or as part of a two-part or multi-part feeder insert, wherein the single-part feeder body then corresponds with a further feeder element to form the feeder cavity. In one embodiment of the invention, the single-part feeder body used as a feeder insert is preferably, after the production of the casting mold, inserted into a recess initially provided for this purpose. At least one wall region of the feeder preferably forms a wall section of the mold cavity of the casting mold. The single-part feeder body is thus retroactively inserted into the already substantially produced casting mold or a mold part of such a casting mold. In a further embodiment according to the invention, the feeder body according to the invention is compacted together with the mold material that forms the casting mold. A feeder body according to the invention is preferably received in a form-fitting manner within the casting mold.

The method described above characterizes a casting method, which preferably comprises as further steps: providing or producing a first mold part which is equipped with at least one feeder body according to the invention (preferably according to any of the preferred embodiments described above) and which has a first parting surface for partially defining the mold cavity of the casting mold; providing or producing at least one second mold part which serves for partially defining the mold cavity of the casting mold and which has a second parting surface of complementary form with respect to the first parting surface, and joining the first parting surface of the first mold part to the second parting surface of the second mold part such that the casting mold which is equipped with at least one feeder body according to the invention (preferably according to any of the preferred embodiments described above) and which has the mold cavity is formed as a result. A casting mold is preferably produced which is assembled from at least two mold parts to be joined together. A feeder insert composed solely of the feeder body according to the invention or a multi-part feeder insert comprising a feeder body according to the invention and at least one further feeder element is arranged at least in one of the mold parts that form the casting mold. The production of the mold part that comprises the feeder body may be performed in a molding chamber into which the mold material for forming the mold part is introduced and subsequently compacted. Depending on the configuration of the feeder insert, whether in single-part or multi-part form, the mold part is produced either with or without the feeder insert. In the case of a multi-part feeder insert according to the invention, this is preferably positioned on a mold plate and/or a mold model in advance, and the feeder insert is compacted together with the mold material to form a solid mold part. A feeder insert composed of only one feeder body according to the invention is preferably, after the production of the mold part, inserted into a recess provided for this purpose. After the at least two mold parts have been produced, it is the case in particular that the parting surfaces, of complementary form, of first and second mold part are joined together.

The method according to the invention is refined by the steps: producing a casting with a residual feeder arranged thereon according to any of the preferred embodiments described above, and processing the cast casting, wherein the residual feeder arranged on the casting is separated off by means of a separating wedge which engages on the outwardly protruding metallic projection of said residual feeder. For the processing, the casting is removed from the casting mold after the metal used to form the casting has solidified and cooled. After the removal from the mold, the residual feeder composed of solidified material can be separated off by means of a separating wedge that engages on an outwardly protruding material projection on the residual feeder.

The preferred embodiments and refinements described with regard to the feeder body according to the invention are at the same time or analogously also preferred embodiments of the feeder insert according to the invention, of the kit for producing a feeder insert, of the device for producing a feeder body and of the method for producing a casting. Preferred embodiments or refinements which are described herein with regard to the feeder insert, with regard to the kit for producing a feeder insert, with regard to the device for producing a feeder body and with regard to the method for producing a casting and which refer to the feeder body are simultaneously also preferred embodiments of the feeder body, etc.

Figure 2:
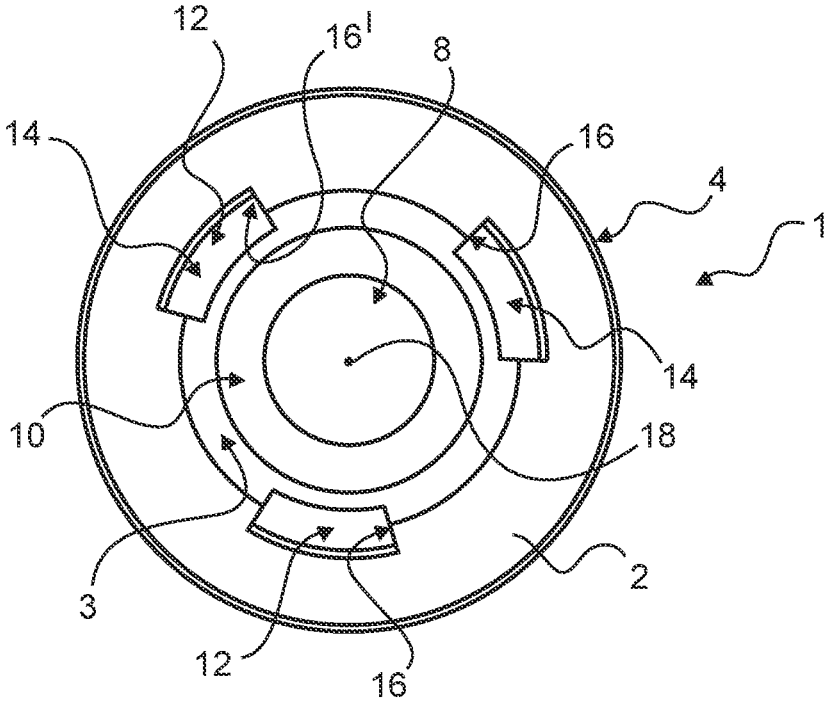
Figure 3:
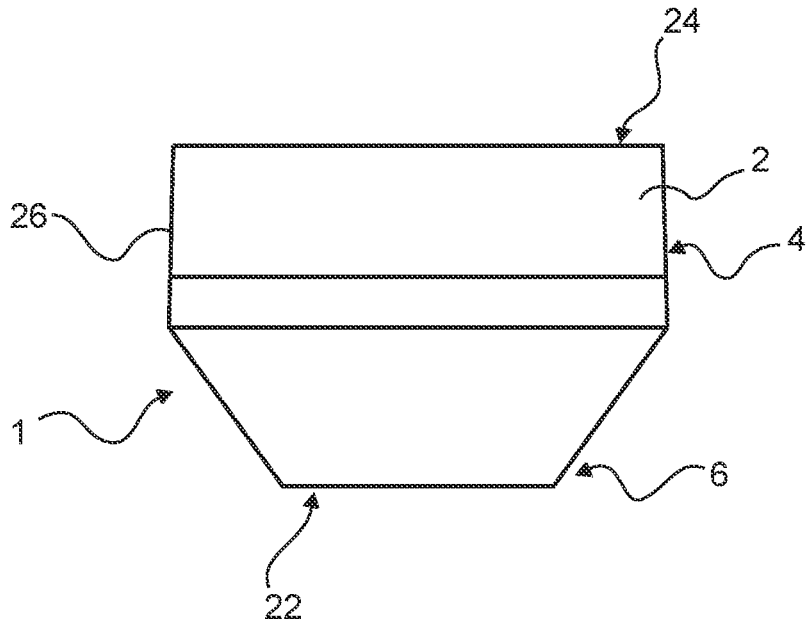
Figure 4:
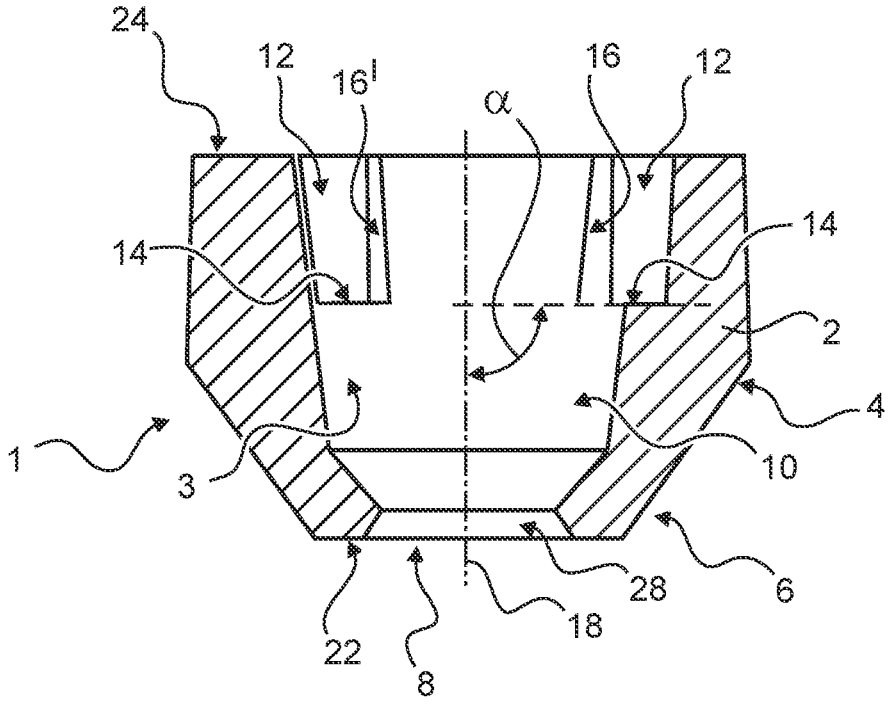
Figure 5:
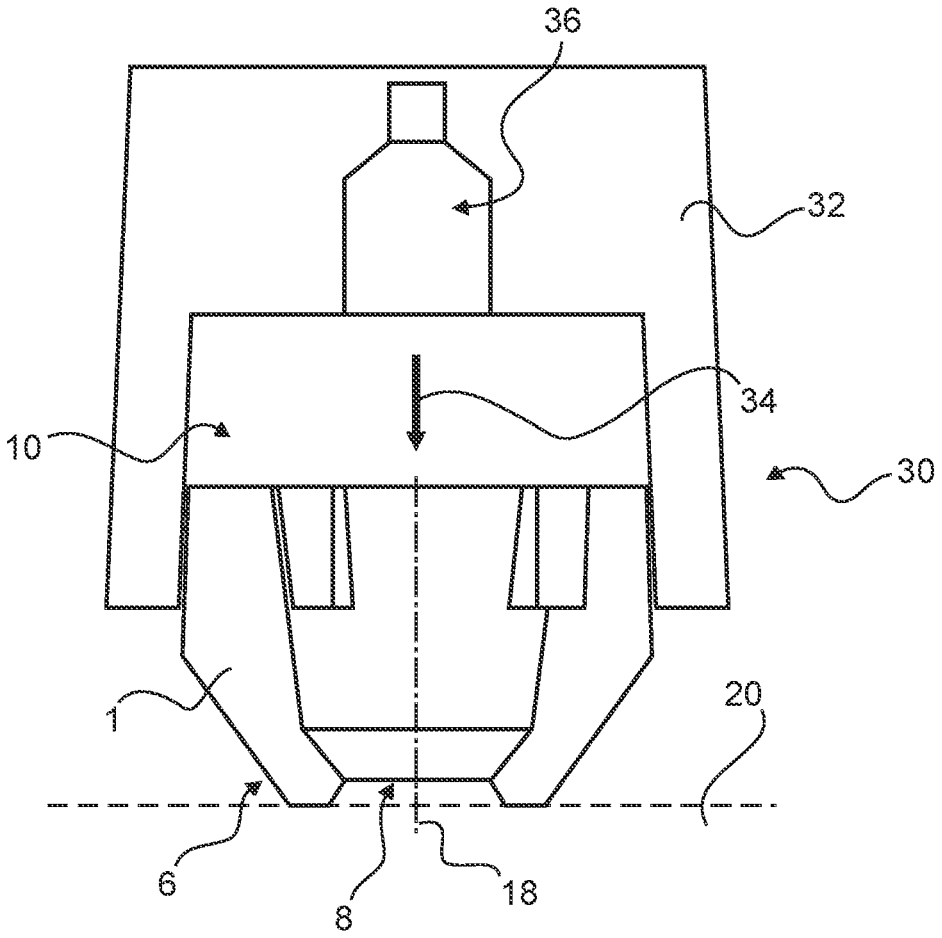

The invention will be described in more detail below, with reference to the appended figures, on the basis of a preferred exemplary embodiment of a feeder body according to the invention and of a feeder insert according to the invention, from which further features which are preferred for the present invention are apparent. In the figures:

FIG. 1: shows a perspective illustration of a feeder body according to the invention for use in metal casting;

FIG. 2: shows a plan view of the feeder body according to the invention as per FIG. 1;

FIG. 3: shows a side view of the feeder body according to the invention;

FIG. 4: shows a sectional illustration of the feeder body according to the invention as per FIG. 1; and FIG. 5: shows a sectional illustration of a feeder insert according to the invention, assembled from a feeder body according to the invention and a feeder element, for use in metal casting in casting molds.

FIG. 1 shows a single-part feeder body 1 according to the invention which is used in metal casting in a casting mold (not shown in any more detail). The feeder body 1 has a feeder wall 2 with an inner surface 3 which is configured to at least partially delimit a feeder cavity 10 (FIG. 4) for receiving liquid metal. The feeder wall 2 of the feeder body 1 furthermore comprises an outer surface 4 which is configured as a bearing surface for a mold material which regionally surrounds the feeder body and by means of which the casting mold is formed. A mounting region 6 of the feeder body is provided on the outer surface 4, by means of which mounting region the feeder body 1 is mounted on a mold model and/or a mold plate 20 (FIG. 5). In an alternative embodiment which is not illustrated, the outer surface has, instead of the mounting region 6, a wall region by means of which a wall section of a mold cavity of the casting mold can be formed.

A passage opening 8 (FIG. 2; FIG. 4) for the liquid metal into the feeder cavity is arranged at the mounting region 6 of the feeder body 1 shown in FIG. 1. According to the invention, the feeder body 1 has three material recesses 12 on its inner surface 3 in the present embodiment, which material recesses are configured such that a corresponding number of outwardly protruding projections are formed on the metal solidifying within the feeder cavity. The material recesses 12 have one or more planar inner surface sections 14 and/or surface regions 16, 16' (FIG. 2) running at an angle α (FIG. 4) with respect to the inner surface 3. In particular, an undercut that acts in the direction of the passage opening 8 is formed by means of the inner surface section 14 of the material recesses 12.

As can be seen from FIG. 2, the multiple material recesses 12 are arranged on the inner surface 3 of the feeder wall 2 at uniform angular intervals around a central axis 18 of the passage opening 8. Adjacent material recesses 12 preferably have an offset of approximately 120 angular degrees with respect to one another on the inner surface 3. The feeder body 1 has a first end 22 defined by the mounting region 6. A second, upper end 24 of the feeder body 1 is formed opposite the first end 22. The second end 24 is designed to be open in the embodiment shown. As can be seen from FIGS. 1 and 4, the material recesses 12 on the inner surface 3 of the feeder wall 2 extend as far as the second end 24 of the feeder body 1. In particular, in the region of the material recesses 12, the wall thickness of the feeder wall 2 in the direction of the outer surface 4 is reduced in relation to the wall thickness from the inner surface 3 to the outer surface 4. In an embodiment that is not shown in any more detail, the material recesses end, spaced apart from the second end, on the feeder body 1 without a step, such that the feeder body, at its upper end, is defined with regard to its cross section solely by the uniform encircling inner surface 3.

FIG. 3 shows a side view of the feeder body 1 according to the invention, which shows that the feeder body 1 has a sleeve section 26 with an outer cross section which increases slightly from the second end in the direction of the first end. A narrowing outer contour, similar to a cone, adjoins the sleeve section 26. In particular, the feeder body 1 has a narrowing mounting region 6. As can also be seen from FIG. 2, the single-part feeder body 1 according to the invention is of substantially rotationally symmetrical form. The single-part feeder body shown in FIG. 3 can, in one embodiment of the invention, be used as a single-part, open or closed feeder insert, not shown in detail, within a casting mold. Such a single-part feeder insert is for example retroactively inserted into a prefabricated casting mold or a prefabricated mold part of a casting mold.

The sectional view of the feeder body 1 according to the invention shown in FIG. 4 illustrates the preferably planar configuration of the inner surface section 14, which protrudes outward from the inner surface 3, for forming the undercut on the inner surface 3. The inner surface section 14 of the material recesses 12 extends to the central axis 18 of the passage opening at an angle α in the range from 70° to 110°. As can also be seen from FIG. 4, the material recess on the inner surface 3 is formed without an undercut in the direction of the second end 24, whereby a feeder body 1 thus designed in accordance with the invention can, after being produced, be removed in a non-destructive manner from a mold part that forms the inner surface 3 of the feeder body 1. This is also achieved in that the inner surface 3 of the feeder wall 2 is designed such that the feeder cavity 10 narrows from the second end 24 of the feeder body 1 in the direction of the passage opening. In particular, the feeder cavity 10 has a cross section that narrows in the direction of the passage opening 8. In the embodiment shown, the inner surface 3 has an approximately conical shape. Furthermore, in the region of the passage opening 8, a constriction 28 with a minimal passage cross section for forming a breaker core is integrated into the feeder body 1.

The material recesses 12 have a height substantially parallel to the central axis of the passage opening 8, which height is in the range of approximately 0.25 to approximately 0.5 in relation to the total height of the feeder body. The material recess has a height dimension of at least 10 mm and a minimum thickness in the region of the greatest offset with respect to the inner surface 3 of at least 3 mm. The absolute dimensions of the material recesses 12 may vary in a manner dependent on the basic dimensions of the single-part feeder body 1 according to the invention.

The feeder body 1 may be formed from an exothermic feeder material or may comprise exothermic feeder material in certain sections. In an alternative embodiment, the feeder body is composed of insulating feeder material or is formed from insulating feeder material at least in certain sections. In a further possible embodiment, the feeder body is formed in certain regions from exothermic and insulating feeder material.

FIG. 5 shows an embodiment of a two-part feeder insert 30 according to the invention, which comprises a feeder body 1 according to the invention which, in the embodiment shown, interacts with a feeder element 32. The feeder cavity 10 is defined by the feeder body 1 and the feeder element 32. The feeder insert 30 is a multi-part, closed feeder with a passage opening 8 at the mounting region 6 of the feeder body 1. Feeder body 1 and feeder element 32 are designed to be telescopic relative to one another, wherein, in the present embodiment, the feeder body 1 usually stands fixedly on a mold plate 20 or on a mold model not illustrated in any more detail. During the compaction of the mold material surrounding the feeder insert 30 to form at least one mold part of a casting mold, the feeder element 32 is moved parallel to the central axis 18 of the feeder body 1 and thus in the longitudinal direction 34 of the feeder insert. In particular, the feeder element 30 is pushed in certain sections over the single-part feeder body 1. As can also be seen from FIG. 5, the feeder element 32 has a receptacle 36 for a centering mandrel which interacts with the feeder insert 30 but which is not shown in any more detail.

LIST OF REFERENCE DESIGNATIONS

1 Feeder body
2 Feeder wall
3 Inner surface
4 Outer surface
6 Mounting region
8 Passage opening
10 Feeder cavity
12 Material recess
14 Inner surface section
16, 16' Surface region
18 Central axis
20 Mold plate
22 First end
24 24 Second end
26 Sleeve section

28 Constriction
30 Feeder insert
34 Feeder element
34 Longitudinal direction
36 Receptacle

I claim:

1. A single-part feeder body (1) for use as a feeder insert or component of a two-part or multi-part feeder insert (30) in metal casting, having a feeder wall (2) which at least partially delimits a feeder cavity (10) for receiving liquid metal, wherein the feeder wall (2) has an inner surface (3) facing toward the feeder cavity (10), an outer surface (4) for bearing against a mold material that surrounds the feeder body (1) in certain regions, and a passage opening (8) for the liquid metal into the feeder cavity (10), wherein the feeder wall (2) has, on the inside, at least one material recess (12) for forming at least one outwardly protruding projection, respectively, on the metal solidifying within the feeder cavity (10), wherein the material recess (12) is designed such that metal solidifying in the feeder cavity (10) forms an undercut.

2. The feeder body (1) as claimed in claim 1, wherein the at least one material recess (12)

defines an inner surface section (14), facing toward the passage opening (8), of the feeder wall, which inner surface section is at an angle α in the range of 70° to 110 with respect to a central axis (18) of the passage opening (8), and/or has one or more planar surface regions (16, 16') which protrude outward in the feeder wall (2).

3. The feeder body (1) as claimed in claim 1, wherein multiple material recesses (12) are arranged at angular intervals around a central axis (18) of the passage opening (8).

4. The feeder body as claimed in claim 3, wherein three material recesses (12) are arranged with an offset of approximately 120 angular degrees with respect to one another on the inner surface (3).

5. The feeder body (1) as claimed in claim 1, wherein the feeder cavity (10) narrows from the at least one material recess (12) in the direction of the passage opening (8)

and/or a constriction (28) with a minimal passage cross section is integrated into the feeder body (1) in the region of the passage opening (8).

6. The feeder body (1) as claimed in claim 1, wherein the feeder body (1) has a first end (22), which defines the passage opening (8), and a second end (24), which is situated opposite the passage opening (8) and which is open.

7. The feeder body (1) as claimed in claim 6, wherein the at least one material recess (12) extends as far as the open second end (24).

8. The feeder body (1) as claimed in claim 1, wherein the at least one material recess (12) on the inside has a height parallel to a central axis (18) of the passage opening (8), which height is in the range of 0.25 to 0.5 in relation to the total height of the feeder body (1).

9. The feeder body (1) as claimed in claim 1, wherein the at least one material recess (12) has a height parallel to a central axis (18) of the passage opening (8) of at least 10 mm and/or a thickness, measured perpendicular to the central axis (18) of the passage opening (8), of at least 3 mm and/or a minimum spacing to the passage opening (8) of approximately 10 mm.

10. The feeder body (1) as claimed in claim 1, wherein the feeder body (1)

(i) is formed from exothermic feeder material or comprises exothermic feeder material in certain sections, and/or (ii) is formed from insulating feeder material or comprises insulating feeder material in certain sections.

11. The feeder body (1) as claimed in claim 1, wherein the feeder cavity (10) is designed to be rotationally symmetrical about a central axis (18) of the passage opening (8)

and/or the outer surface of the feeder body (1) is designed to be symmetrical in a plane running through the central axis (18) of the passage opening (8), and/or the feeder body (1) has a mounting region (6) which narrows in the direction of the passage opening (8) and which serves for mounting on a mold model or on a mold plate (20).

12. A two-part or multi-part feeder insert (30) for use in metal casting in casting molds, comprising a feeder body (1) as claimed in claim 1, and one or more further feeder elements (32), wherein the feeder body (1) is connected to the one or more further feeder elements (32) to form the feeder insert (30) and wherein the feeder body (1) together with the one or more further feeder elements (32) defines the feeder cavity (10).

13. The feeder insert (30) as claimed in claim 12, wherein the feeder body (1) and the one or more further feeder elements (32) are designed to be telescopic relative to one another.

14. The feeder insert (30) as claimed in claim 12, wherein the feeder body (1) has a narrowing mounting region (6) on its outer surface, and/or wherein the feeder body (1), as a lower part of a feeder insert (30), is of rotationally symmetrical form.

15. A kit for producing feeder inserts (30), comprising one or more feeder bodies (1) as claimed in claim 1, and at least two further feeder elements (32) which correspond with the one or more feeder bodies (1) such that two or more different feeder inserts (30) can be generated, wherein each feeder cavity has a different volume.

16. The kit as claimed in claim 15, comprising a centering mandrel which corresponds with a passage opening (8) in the one or more feeder bodies (1).

17. A device for producing a feeder body (1) as claimed in claim 1, comprising: a molding box, having at least two mold parts which are movable relative to one another, wherein a first mold part is configured to at least regionally form the outer surface of the feeder body (1), and wherein a second mold part is configured to at least regionally form the inner surface (3), which delimits the feeder cavity (10), of the feeder body (1), wherein the second mold part, on its surface that at least regionally forms the inner surface (3) of the feeder body (1), has one or more outwardly protruding mold part projections which are configured to form the at least one material recess (12).

18. A method for producing a casting with a residual feeder arranged thereon, wherein the residual feeder has at least one outwardly protruding metallic projection as a counterbearing for a separating wedge that can be brought into contact with the at least one metallic projection, comprising the steps:

providing or producing a casting mold which is equipped with at least one feeder body (1) as claimed in claim 1 and which has a mold cavity;

casting liquid metal into the mold cavity of the casting mold through a sprue formed on the casting mold, such that liquid metal enters the feeder cavity, allowing the metal to solidify in the mold cavity and in the feeder cavity (10), such that the residual feeder is formed as a result.

19. The method as claimed in claim 18, comprising the steps:

providing or producing a first mold part which is equipped with at least one feeder body (1) as claimed in claim 1 and which has a first parting surface for partially defining the mold cavity of the casting mold;

providing or producing a second mold part which serves for partially defining the mold cavity of the casting mold and which has a second parting surface of complementary form with respect to the first parting surface, joining the first parting surface of the first mold part to the second parting surface of the second mold part, such that the casting mold which is equipped with the at least one feeder body (1) and which has the mold cavity is formed as a result.

20. A method for producing a casting, having the following steps:

producing a casting with a residual feeder arranged thereon as claimed in claim 18, and processing the casting, wherein the residual feeder arranged on the casting is separated off by means of a separating wedge which engages on the at least one outwardly protruding metallic projection of said residual feeder.

* * * * *